US009022742B2

(12) United States Patent
Miller et al.

(10) Patent No.: US 9,022,742 B2
(45) Date of Patent: May 5, 2015

(54) BLADE SHROUD FOR FLUID ELEMENT

(75) Inventors: Jeff H. Miller, Canoga Park, CA (US); Kelvin Sorensen, Canoga Park, CA (US); John Fung, Canoga Park, CA (US); Thaddeus Pearce Chilcoat, Canoga Park, CA (US); Fabian Bitar, Canoga Park, CA (US)

(73) Assignee: Aerojet Rocketdyne of DE, Inc., Canoga Park, CA (US)

( * ) Notice: Subject to any disclaimer, the term of this patent is extended or adjusted under 35 U.S.C. 154(b) by 629 days.

(21) Appl. No.: 13/343,026

(22) Filed: Jan. 4, 2012

(65) Prior Publication Data

US 2013/0170993 A1 Jul. 4, 2013

(51) Int. Cl.

| | |
|---|---|
| ***F01D 5/14*** | (2006.01) |
| ***F01D 5/04*** | (2006.01) |
| ***F01D 5/34*** | (2006.01) |

(52) U.S. Cl.
CPC *F01D 5/048* (2013.01); *F01D 5/34* (2013.01); *F05D 2240/304* (2013.01)

(58) Field of Classification Search
USPC ..... 416/182, 183, 185, 186 R
See application file for complete search history.

(56) References Cited

U.S. PATENT DOCUMENTS

| | | | | |
|---|---|---|---|---|
| 2,912,157 | A | | 11/1959 | Taylor |
| 4,326,836 | A | | 4/1982 | Fitton |
| 4,634,344 | A | * | 1/1987 | Zagar et al. ..... 416/175 |
| 5,290,148 | A | * | 3/1994 | Tsunoda et al. ..... 416/186 R |
| 5,342,171 | A | | 8/1994 | Stanko |
| 5,439,348 | A | | 8/1995 | Hughes et al. |
| 5,460,488 | A | | 10/1995 | Spear et al. |
| 6,123,507 | A | * | 9/2000 | Weis ..... 416/144 |
| 7,066,714 | B2 | | 6/2006 | Miller et al. |
| 7,070,388 | B2 | | 7/2006 | Meng et al. |
| 8,784,060 | B2 | * | 7/2014 | Iwata et al. ..... 416/185 |
| 2010/0226773 | A1 | * | 9/2010 | Bruhn et al. ..... 416/87 |
| 2012/0141261 | A1 | * | 6/2012 | Giovannetti et al. ..... 415/203 |
| 2013/0149157 | A1 | * | 6/2013 | Shoji ..... 416/182 |

FOREIGN PATENT DOCUMENTS

| | | | |
|---|---|---|---|
| JP | S 55-51992 A | * | 4/1980 |
| JP | S 55-146274 A | * | 11/1980 |
| WO | WO 2006/133363 | * | 12/2006 |

OTHER PUBLICATIONS

Kodama, Pump Impeller, Apr. 16, 1980, Abstract of JPS55-51992A.*
Mimori, WaterTurbine Runner, Nov. 14, 1980, Abstract of JPS55-146274A.*

* cited by examiner

*Primary Examiner* — Liam McDowell
(74) *Attorney, Agent, or Firm* — Joel G Landau

(57) ABSTRACT

The disclosed fluid elements include radial blades extending to trailing edges and that are integral with front and rear shrouds to provide a fluid exit. Fillets adjoin the trailing edge and the front and rear shrouds at the exit. The front and rear shrouds respectively have first and second perimeter thicknesses at the impeller outer perimeter. The first perimeter thickness is greater than the second perimeter thickness at the trailing edge and adjacent to the exit, which provides greater high cycle fatigue in the area of the fillets.

1 Claim, 5 Drawing Sheets

BLADE SHROUD FOR FLUID ELEMENT

This invention was made with government support from the National Aeronautics and Space Administration under Contract No.: NNM06AB13C. The government may have certain rights to this invention pursuant to Contract No. NNM06AB13C awarded by the National Aeronautics and Space Administration.

BACKGROUND

This disclosure relates to a fluid element, such as an impeller, having front and rear shrouds integral with the blades.

One type of fluid machine, such as a turbomachine pump, has a radial impeller with front and rear shrouds integral with the impeller blades to provide an interior pumping surface. The blades are circumferentially arranged to provide circumferentially spaced exits about the impeller outer perimeter. Trailing ends of the blades extend to the impeller outer perimeter.

The front and rear shrouds respectively include first and second perimeter surfaces at the impeller outer perimeter. Typically the first and second perimeter surfaces have thicknesses that are the same as one another. Some impellers have a thick rear shroud that provides a second perimeter surface that is thicker than the first perimeter surface. Other impellers have the trailing edges and the immediately surrounding portions of the first and second perimeter surfaces recessed radially inwardly from the impeller outer perimeter to accommodate a balance piston.

BRIEF DESCRIPTION OF THE DRAWINGS

The disclosure can be further understood by reference to the following detailed description when considered in connection with the accompanying drawings wherein.

Like numerals in the Figures indicate like elements.

DETAILED DESCRIPTION

Figure 1:
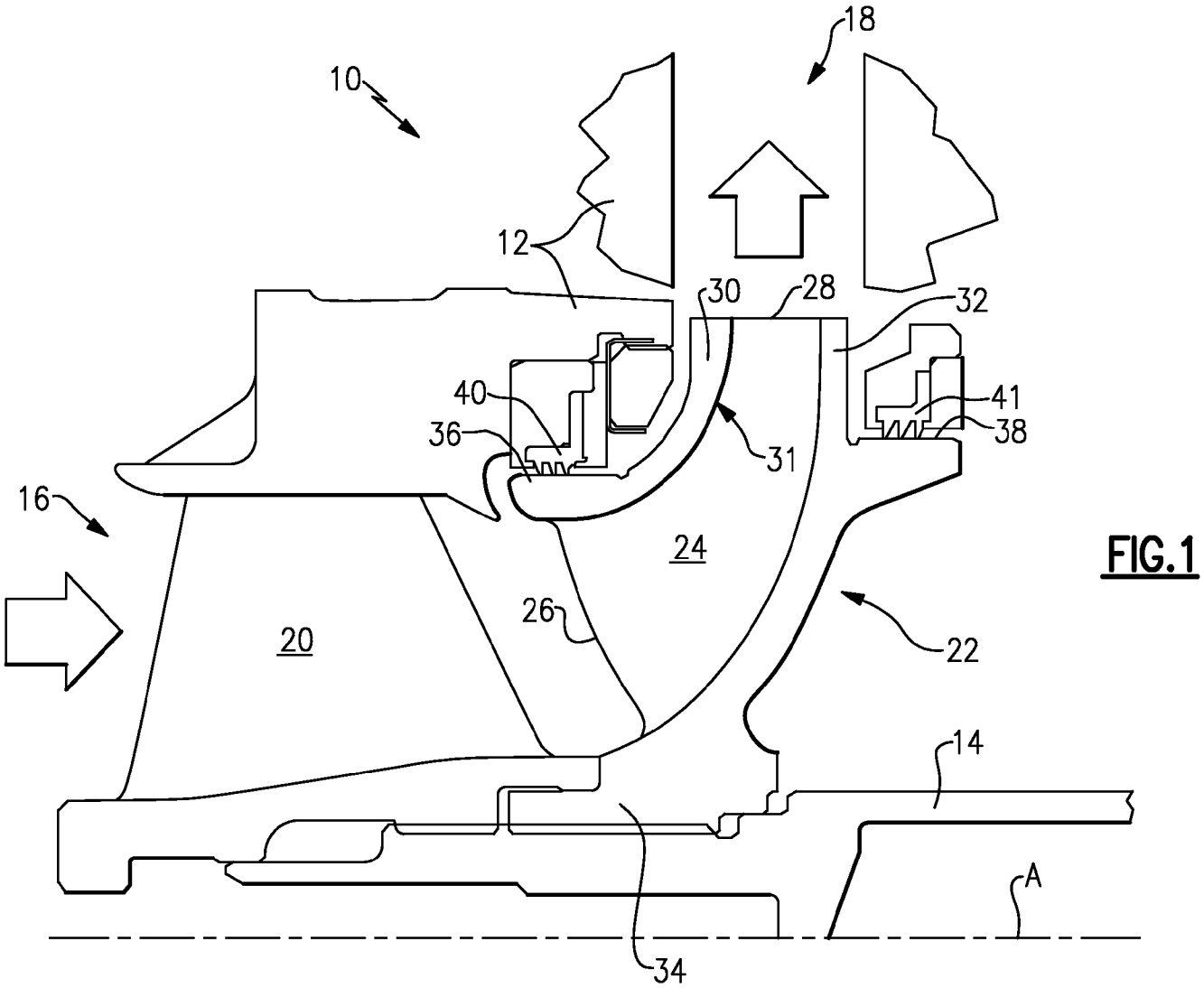
FIG. 1 is a partial cross-sectional view of a turbomachine pump.

A pump 10 is schematically illustrated in FIG. 1 and includes a shaft 14 arranged in a housing 12. The housing 12 provides an inlet 16 and an outlet 18 providing a radial compressor flow path. An impeller 22 is mounted on the shaft 14 for rotation about an axis A and is fluidly arranged between the inlet 16 and the outlet 18. In the example arrangement, inducer vanes 20 are arranged in the inlet 16 upstream from the impeller 22. It should be understood that this disclosure relates to fluid elements for fluid machines generally, including pumps and turbines. The disclosed impellers are intended to be exemplary.

Figure 2:
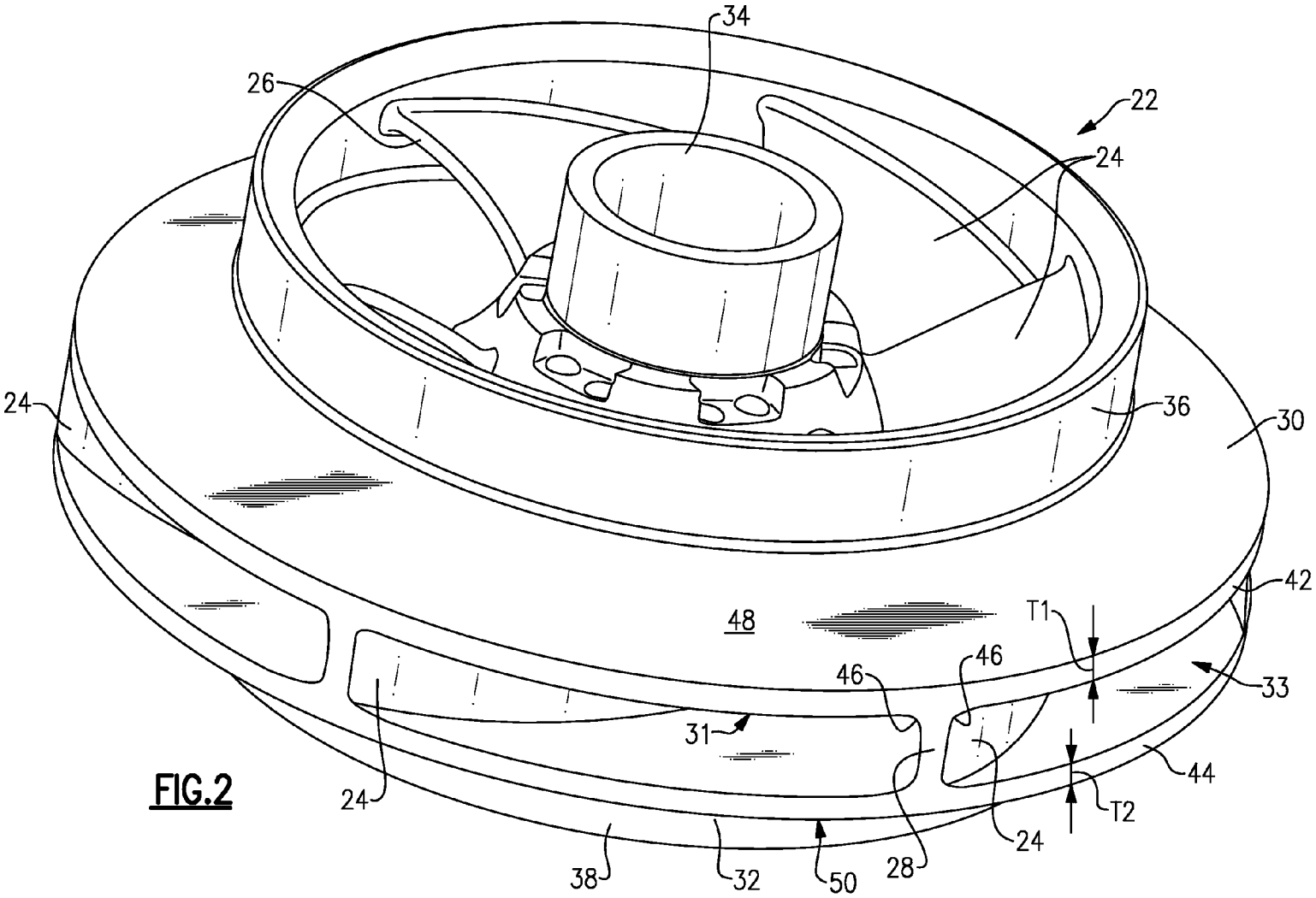
FIG. 2 is a perspective view of an impeller for the pump shown in FIG. 1.

The impeller 22 includes circumferentially arranged blades 24 each extending from a leading edge 26 at the inlet 16 to a trailing edge 28 at the outlet 18. The example impeller 22 includes six blades 24. As shown in FIGS. 1 and 2, the impeller 22 includes an integral shroud provided by spaced apart front and rear shrouds 30, 32 adjoining the blades 24 to provide a one-piece, unitary structure. A space defined by the front and rear shrouds 30, 32 and the blades 24 provides an interior pumping surface 31. The front shroud 30 provides the inner radius of the pumping surface 31, and the rear shroud 32 provide the outer radius of the pumping surface 31.

An inner portion of the rear shroud 32 provides a hub 34, which is supported by the shaft 14. The front and rear shrouds 30, 32 respectively include outer cylindrical portions that provide first and second seal lands 36, 38, respectively. Referring to FIG. 1, seals 40, 41 engage the first and second seal lands 36, 38 to prevent pumped fluid from escaping the flow path.

The front and rear shrouds 30, 32 respectively include first and second perimeter surfaces 42, 44 that are flush with the trailing edge 28 to provide circumferential exits 33, best shown in FIG. 2. The portions of the perimeter surfaces 42, 44 and trailing edge 28 circumscribing the exits 33 form a cylindrical surface. Fillets 46 adjoin the pumping surface 31 and the trailing edge 28 at the first and second perimeter surfaces 42, 44. In the example, the perimeter surfaces 42, 44 do not include any features that extend radially proud of the trailing edge 28.

The front and rear shrouds 30, 32 have an axial thickness extending from the pumping surface to front and rear outer surfaces 48, 50. The front and rear outer surfaces 48, 50 opposite each include portions adjoining the trailing edge 28 that are parallel with one another. The first and second perimeter surfaces 42, 44 have first and second thicknesses T1, T2, respectively, at the exit 33 and extending in the axial direction. Typically, the first and second thicknesses T1, T2 are equal to one another. The disclosed impellers 122, 222, 322 (FIGS. 3A-5B) have a first perimeter thickness T1 that is greater than the second perimeter thickness T2 at the trailing edge and adjacent to the exit, which provides greater high cycle fatigue in the area of the fillets.

Figures 3A, 3B:
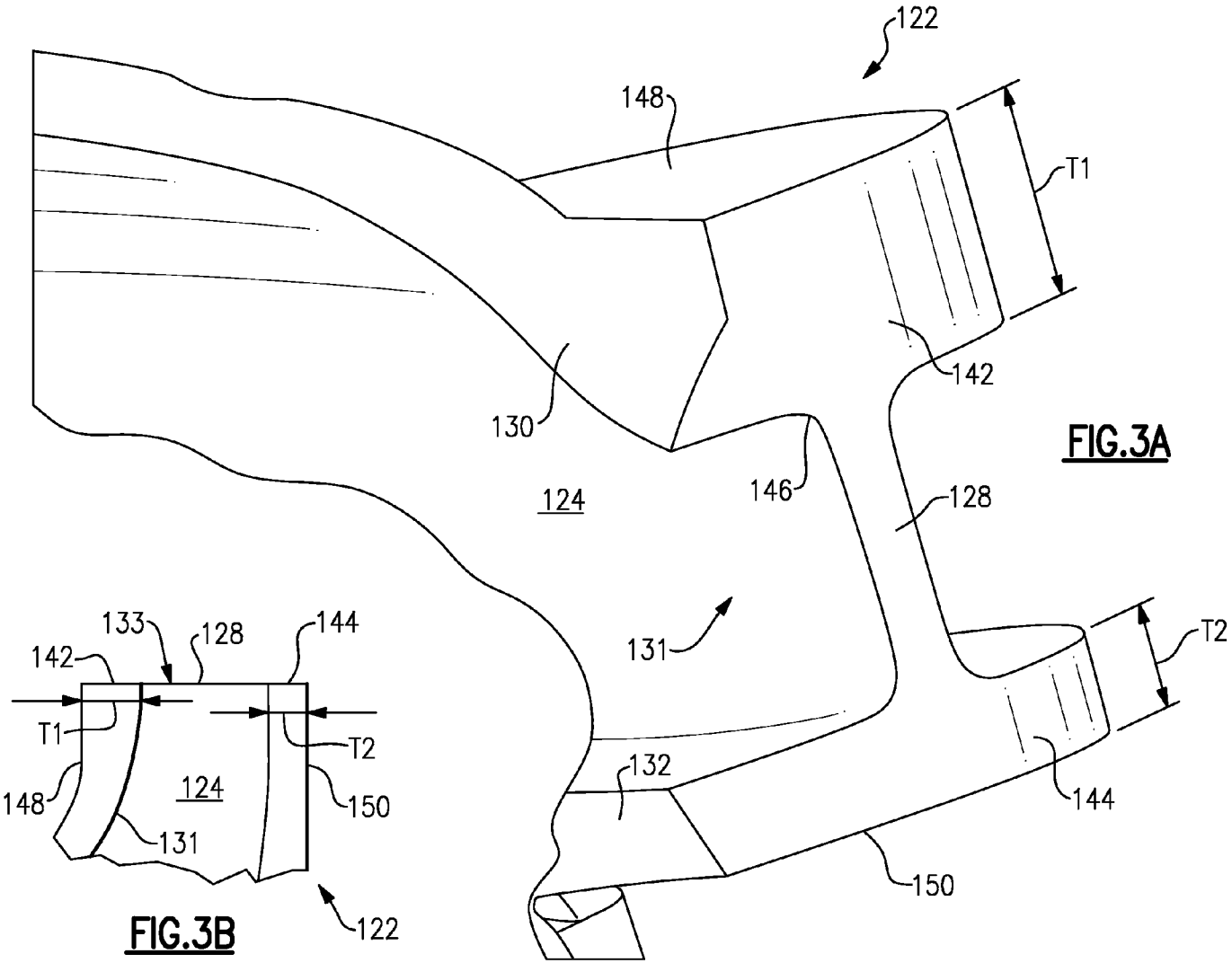
FIG. 3A is a partial perspective view of an example impeller for the pump shown in FIG. 1.
FIG. 3B is a partial cross-sectional view of the impeller shown in FIG. 3A.

In the example shown in FIGS. 3A-3B, the blades 124 and front and rear shrouds 130, 132 provide a pumping surface 131 that terminate in an exit 133. The trailing edge 128 and first and second perimeter surfaces 142, 144 are flush with one another at fillets 146 and are adjacent to the exit 133. The front outer surface 148 and pumping surface 131 provides a front shroud thickness that provides a first thickness T1 near the trailing edge 128. The rear outer surface 150 and pumping surface 131 provides a rear shroud thickness that provides a second thickness T2 near the trailing edge 128. In one example, the first thickness T1 is approximately twice that of the second thickness T2. The front outer surface 148 provides a smooth transition or contour to the first perimeter surface 142.

Figures 4A, 4B:
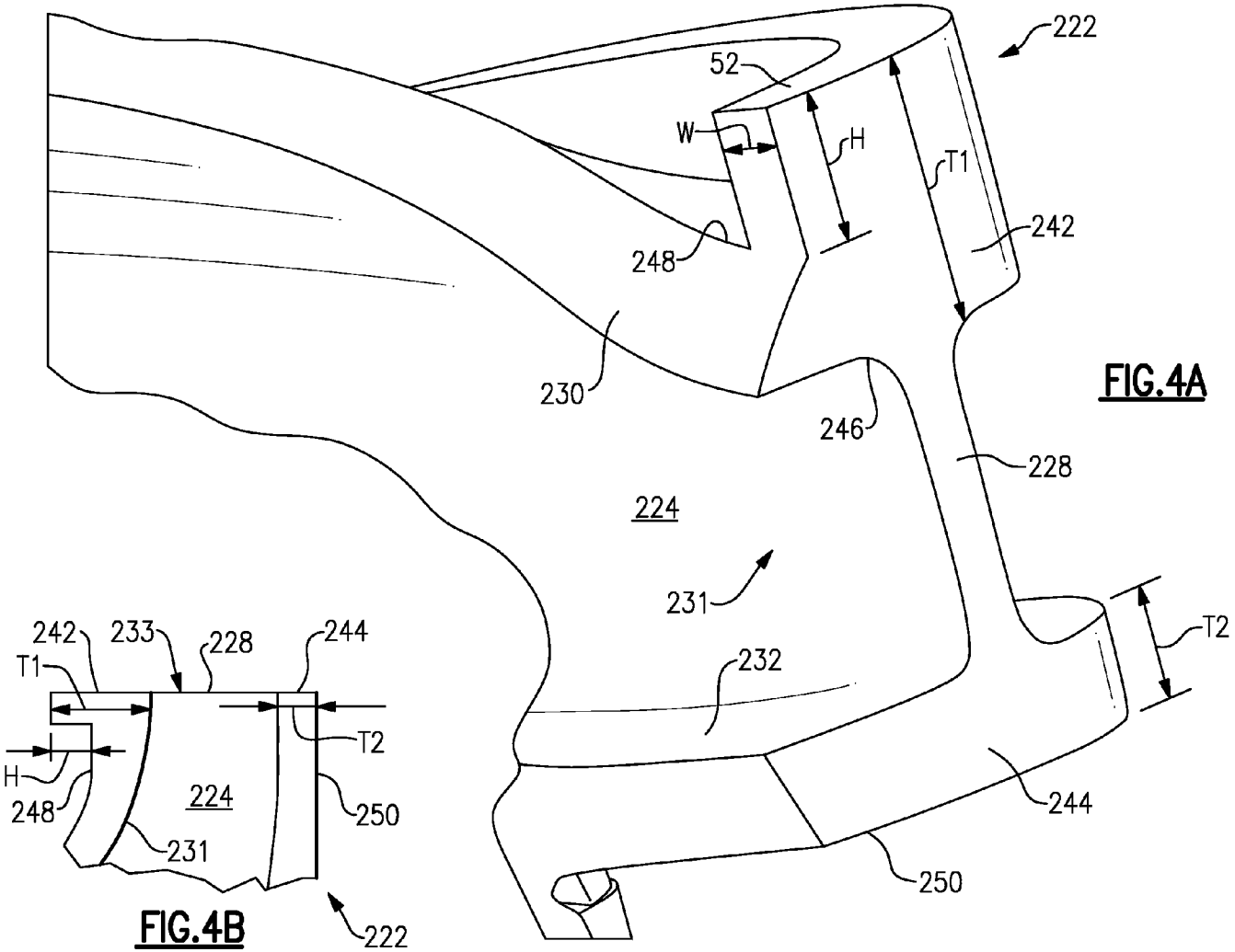
FIG. 4A is a partial perspective view of another example impeller for the pump shown in FIG. 1.
FIG. 4B is a partial cross-sectional view of the impeller shown in FIG. 4A.

In the example shown in FIGS. 4A-4B, the blades 224 and front and rear shrouds 230, 232 provide a pumping surface 231 that terminate in an exit 233. The trailing edge 228 and first and second perimeter surfaces 242, 244 are flush with one another at fillets 246 and are adjacent to the exit 233. The front outer surface 248 and pumping surface 231 provides a front shroud thickness that provides a first thickness T1 near the trailing edge 228. The rear outer surface 250 and pumping surface 231 provides a rear shroud thickness that provides a second thickness T2 near the trailing edge 228. In one example, the first thickness T1 is about twice that of the second thickness T2. The front outer surface 248 is axially recessed a height H from the first perimeter surface 242 providing an abrupt step 52. The height H is about half the first thickness T1 in one example.

Figure 5A:
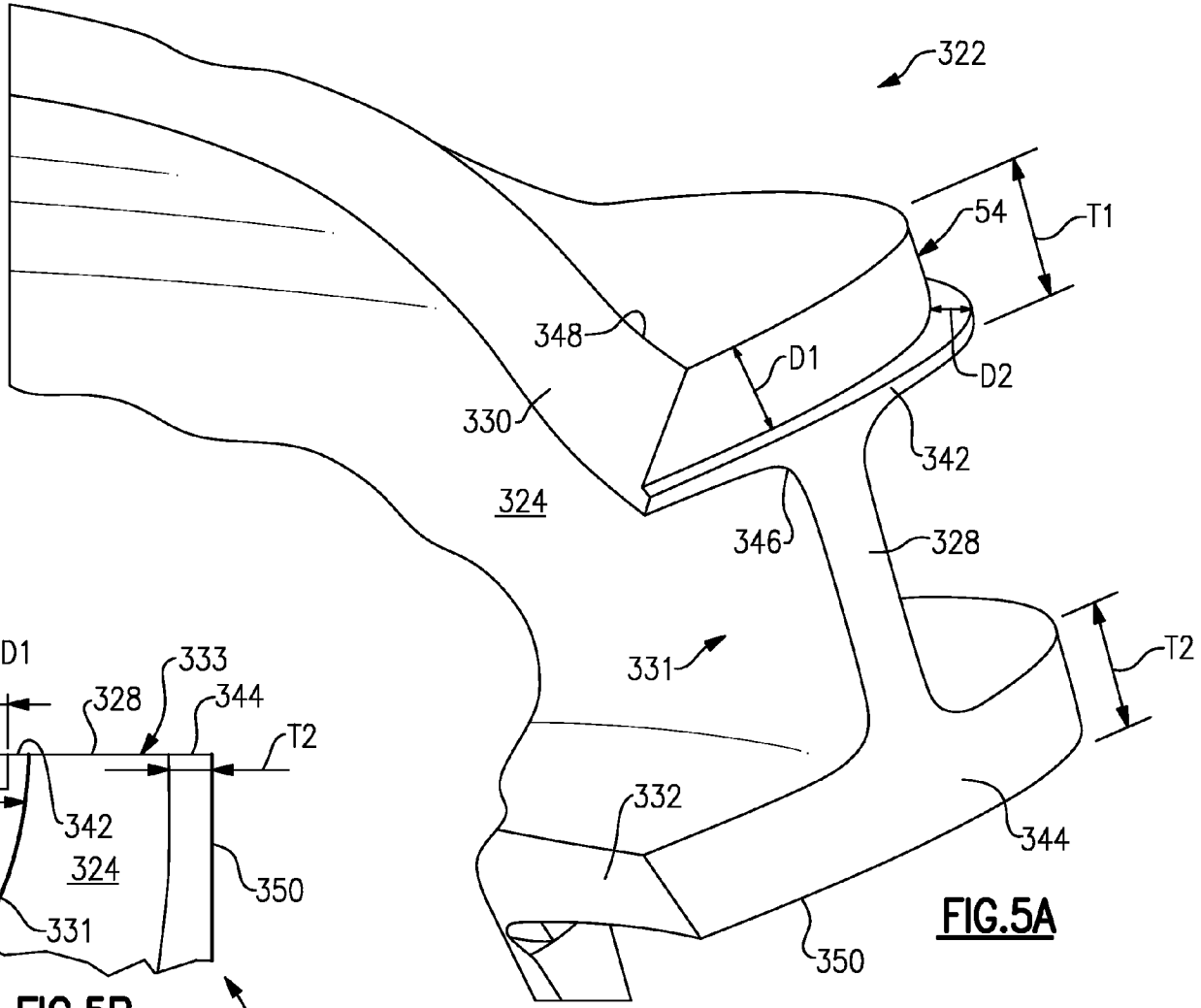
FIG. 5A is a partial perspective view of yet another example impeller for the pump shown in FIG. 1.
Figure 5B:
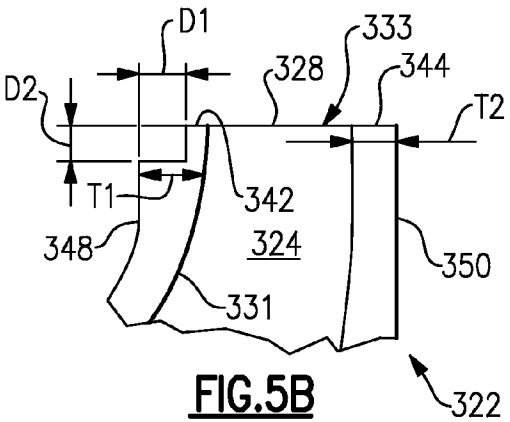
FIG. 5B is a partial cross-sectional view of the impeller shown in FIG. 5A.

In the example shown in FIGS. 5A-5B, the blades 324 and front and rear shrouds 330, 332 provide a pumping surface 331 that terminate in an exit 333. The trailing edge 328 and first and second perimeter surfaces 342, 344 are flush with one another at fillets 346 and are adjacent to the exit 333. The front outer surface 348 and pumping surface 331 provides a front shroud thickness that provides a first thickness T1 near the trailing edge 328. The rear outer surface 350 and pumping surface 331 provides a rear shroud thickness that provides a second thickness T2 near the trailing edge 328. In one example, the first thickness T1 is approximately twice that of the second thickness T2. In the area immediately adjacent to the exit 333, a relative small portion or lip of the first perimeter surface 342 is flush with the exit 333. The remaining portion of the first perimeter surface 333 includes an annular recess 54 recesses an axial depth D1 and a radial depth D2. In one example, the axial depth D1 is about two thirds the first thickness T1. The axial depth D1 is about twice the radial depth D2.

Although example embodiments have been disclosed, a worker of ordinary skill in this art would recognize that certain modifications would come within the scope of the claims. For that reason, the following claims should be studied to determine their true scope and content.

What is claimed is:

1. A fluid element for a fluid machine comprising:

circumferentially arranged blades extending radially from a leading edge to a trailing edge; and front and rear shrouds spaced apart from one another and integral with the blades to provide an interior pumping surface, wherein the front shroud has a front outer surface, the front and rear shrouds respectively including first and second perimeter surfaces having respective fillets, and a corresponding first greatest thickness and a second greatest thickness, wherein the front outer surface has a smooth contour to the first perimeter surface, the first greatest thickness greater than the second greatest thickness only at the trailing edge and adjacent to the exit.

* * * * *